US005201444A

United States Patent [19]

Simonet

[11] Patent Number: 5,201,444

[45] Date of Patent: Apr. 13, 1993

[54] DISPENSING APPARATUS

[76] Inventor: Susan S. Simonet, 174 Sandstone Dr., Taylors, S.C. 29687

[21] Appl. No.: 693,159

[22] Filed: Apr. 29, 1991

[51] Int. Cl.[5] ..... A45F 5/00

[52] U.S. Cl. ..... 224/183; 224/219

[58] Field of Search ..... 224/183, 222, 217-219, 224/267; 248/309.4

[56] References Cited

U.S. PATENT DOCUMENTS

| | | | |
|---|---|---|---|
| 1,174,887 | 3/1916 | Meriwether | 224/183 X |
| 2,176,052 | 10/1939 | Beyer | 224/183 X |
| 2,436,607 | 2/1948 | Rosenthal | 224/183 |
| 2,452,400 | 10/1948 | Stevens | 224/183 |
| 3,896,527 | 7/1975 | Miller et al. | 224/222 X |
| 4,880,152 | 11/1989 | Trankle | 224/267 |

FOREIGN PATENT DOCUMENTS

| | | | |
|---|---|---|---|
| 0372566 | 7/1939 | Italy | 224/183 |
| 0030395 | of 1911 | United Kingdom | 224/183 |
| 0649678 | 1/1951 | United Kingdom | 224/183 |

*Primary Examiner*—Henry J. Recla
*Assistant Examiner*—Casey Jacyna
*Attorney, Agent, or Firm*—Bailey & Hardaway

[57] ABSTRACT

A novel dispensing apparatus and method for dispensing objects responsive to magnetic attraction retained thereon is provided comprising a strap and a permanent magnet in the form of a ring attached to the strap whereby objects responsive to magnetic attraction may be retained thereon for dispensing.

5 Claims, 1 Drawing Sheet

DISPENSING APPARATUS

BACKGROUND OF THE INVENTION

This invention relates generally to the art of dispensing and, more particularly, to the art of dispensing magnetically attracted objects.

It is known within the prior art to use magnetic devices for nailing. It is also known within the prior art to attach pin cushions to the wrist of a user and to retain pins in the cushion. Such a use of a pin cushion, however, suffers from the disadvantage of having to individually place the pins in the cushion in order to have the cushion retain them. Also, only items such as pins, small and pointed, can usually be retained on such a cushion.

There has to date, however, been no completely satisfactory apparatus or method for quickly and easily grasping, retaining and dispensing such objects.

SUMMARY OF THE INVENTION

It is thus an object of this invention to provide a novel apparatus and method for dispensing objects responsive to magnetic attraction.

This object as well as other objects is accomplished by providing a dispensing apparatus comprising a strap for placement around the wrist of a user and a permanent magnet in the form of a ring attached to the strap whereby objects responsive to magnetic attraction may be retained for dispensing.

The process is carried out by the user reaching into a group of magnetically attracted objects with the dispensing apparatus attached to the wrist of the user whereby the magnet of the dispensing apparatus attracts and retains the objects to be dispensed, removing the wrist having the dispensing apparatus thereon and the objects to be dispensed retained on the magnet, and removing the objects to be dispensed from the magnet of the dispensing apparatus.

Other objects and a fuller understanding of the invention will become apparent from the following description given with reference to the various figures of drawing.

DETAILED DESCRIPTION

In accordance with this invention it has been found that a novel dispensing apparatus and method of dispensing is provided for retaining and dispensing objects responsive to magnetic attraction.

Particularly, this invention provides a dispensing apparatus in the form of a magnet attached to the wrist of a user. The magnet may be used to attract, retain and dispense difficult to handle magnetic objects, such as nails, tacks, etc. The user simply places the magnet near a source of the magnetic objects where they are attracted and retained. The user simply removes the objects in a seriatim fashion as they are required for use, such as a nail for hammering.

Various other advantages and features will become apparent from the following description given with reference to the various figures of drawing.

Figure 1:
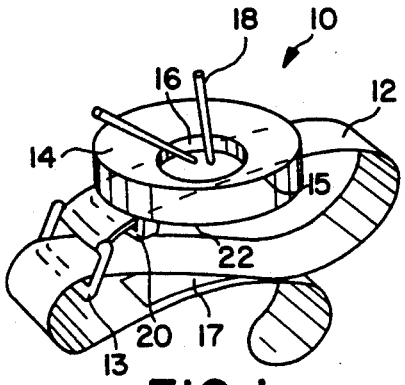
FIG. 1 is a perspective view of the dispensing apparatus having objects responsive to magnetic attraction retained thereon.

FIG. 1 is a perspective view of the dispensing apparatus 10 according to this invention. As illustrated, dispensing apparatus 10 comprises a strap 12 and a permanent magnet 14 in the form of a ring attached to the strap 12. It is contemplated that strap 12 may be constructed of various materials and that various ways exist to attach strap 12 to the wrist of a user. In a preferred embodiment, however, strap 12 comprises a VELCRO or hook and loop fastener portion 17, which enables strap 12 to be easily attached and removed from the wrist of a user. Metal loop 13 can also be used in conjunction with strap 12 to aid attaching and removing strap 12.

Permanent magnet 14 is in the form of a ring and attached to strap 12 by way of a base member 22. Magnet 14 is attached to and overlies base member 22, and base member 22 defines a slot 20 through which the strap 12 passes to attach magnet 14 to strap 12. As illustrated in FIG. 1, objects 18 responsive to magnetic attraction may be retained on magnet 14 for dispensing thereof. Also as illustrated in FIG. 1, magnet 14 is saucer-shaped, having an outer edge 15 and an inner edge 16. The outer edge 15 of magnet 14 slopes downwardly to the inner edge 16 to form the saucer shape in order to aid in grasping objects 18 that are retained on magnet 14.

Figure 2:
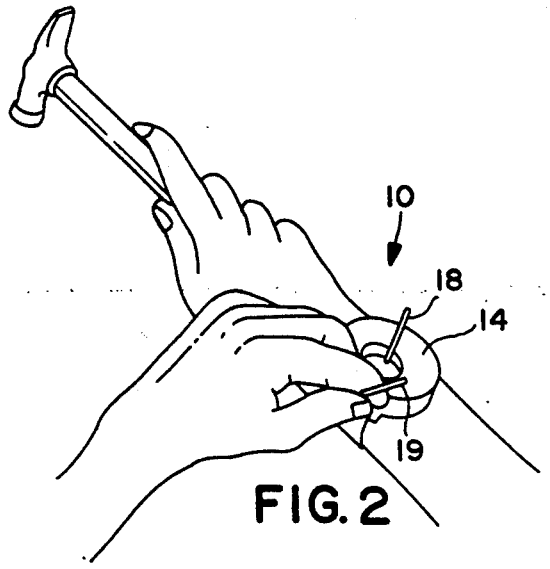
FIG. 2 is a perspective view of the dispensing apparatus attached to the wrist of a user illustrating removal of an object responsive to magnetic attraction from the dispensing apparatus.

FIG. 2 is a perspective view of the dispensing apparatus 10 attached to the wrist of a user illustrating the removal of an object 18 which is retained on magnet 14 of the dispensing apparatus 10. The objects 18 responsive to magnetic attraction are shown retained on magnet 14 as magnet 14 is in the form of a saucer-shaped ring to aid in retaining the objects 18. Such objects 18 may be retained on magnet 14 until such time when they need to be removed or dispensed. The saucer-shaped ring form of the magnet 14 enables an object 18 retained thereon to be easily removed from magnet 14, as object 19 is shown being removed from magnet 14.

Figure 3:
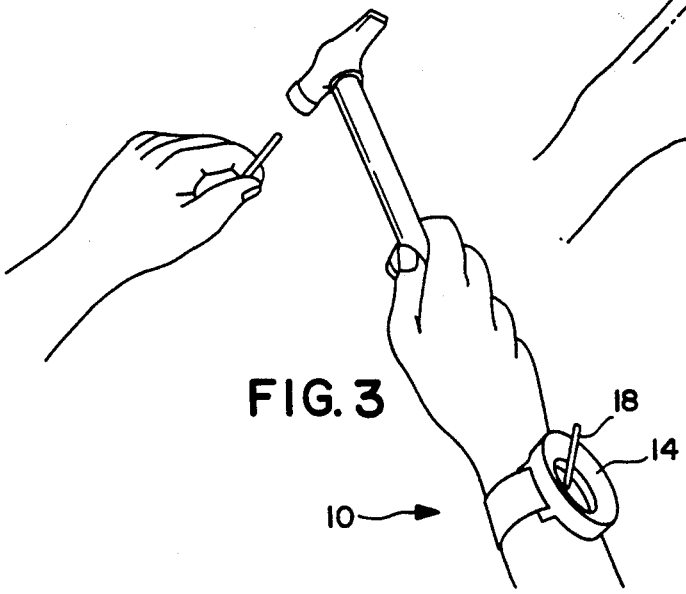
FIG. 3 is a perspective view of the dispensing apparatus attached to the wrist of a user shown using the dispensing apparatus.

FIG. 3 is a perspective view of the dispensing apparatus 10 attached to the wrist of a user shown using the dispensing apparatus 10. As FIG. 3 clearly illustrates, it is an advantage of the present invention that objects 18 responsive to magnetic attraction may be retained on magnet 14 of the dispensing apparatus 10 while the hands of a user are free to engage in other activities. The saucer-shaped ring form of the magnet 14 aids in retaining objects 18 as well as aids in the removal of objects 18 when such removal is desired.

Figure 4:
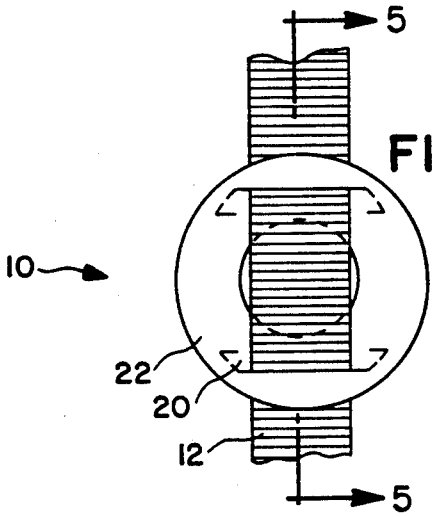
FIG. 4 is a rear view of the dispensing apparatus according to this invention.

In addition to providing a novel dispensing apparatus 10, the present invention also provides a novel process for dispensing objects 18 responsive to magnetic attraction. With the dispensing apparatus 10 strapped to the wrist of a user, the wrist and dispensing apparatus 10 can be reached into a group of magnetically attractive objects, such as objects 18 which can be nails, screws, bolts, nuts, or other magnetically responsive objects, whereby the magnet 14 of the dispensing apparatus 10 attracts and retains such objects 18 to be dispensed. The wrist and the dispensing apparatus 10 may then be removed from the group of magnetically attractive objects, and the magnet 14 of the dispensing apparatus 10 will have a plurality of objects 18 retained in the saucer-shaped ring of the magnet 14. Each of the objects 18 may then be removed from magnet 14 in seriatim manner to be furthered dispensed. This novel process makes dispensing of objects 18 responsive to magnetic attraction a simple task. It also frees the hands of a user of the dispensing apparatus 10 while such objects 18 are retained for dispensing. FIG. 4 is a rear view of the dispensing apparatus 10 according to this invention illustrating the strap 12 having the base member 22 attached to it. In a preferred embodiment, the ring form of the permanent magnet (not shown) is attached to and overlies a base member 22 which defines a slot 20 through which strap 12 passes. The slot 20 enables the permanent magnet (not shown) to be attached to strap 12 by way of base member 22 in a manner in which the position of magnet and base member 22 on strap 12 may be easily adjusted.

Figure 5:
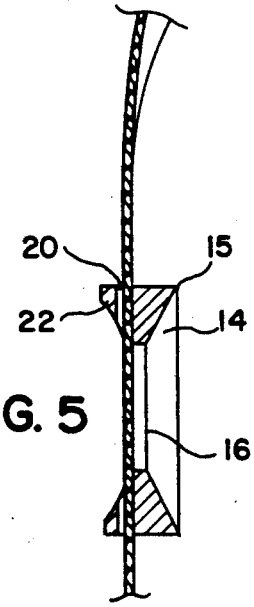
FIG. 5 is a cross section view taken along line 5—5 of FIG. 4.

FIG. 5 is a cross section view taken along line 5—5 of FIG. 4. As illustrated, magnet 14 is saucer-shaped, having an outer edge 15 and an inner edge 16. The outer edge 15 slopes downwardly to the inner edge 16 to aid in grasping objects retained on magnet 14. Also illustrated in FIG. 5, is slot 20 which is defined b base member 22 to which magnet 14 is attached and overlies so that the strap 12 may be inserted through slot 20.

It is thus seen that the invention provides a novel apparatus and method for dispensing objects responsive to magnetic attraction. Many variations are apparent to those of skill in the art, and such variations are embodied within the spirit and scope of the present invention as measured by the following appended claims.

That which is claimed:

1. A dispensing apparatus comprising:

a strap for placement around the wrist of a user;

a permanent magnet in the form of a ring defining a center aperture therethrough whereby objects responsive to magnetic attraction may be retained for dispensing, said ring being annular and comprising an outer edge and an inner edge and having a saucer-shaped surface such that said ring sloped downwardly from said outer edge to said inner edge said ring having a base member below said saucer-shaped surface to which said strap is attached, wherein said center aperture extends through said saucer-shaped surface and said base member to said strap whereby objects placed on said saucer-shaped surface are able to contact said strap through said center aperture.

2. The dispensing apparatus according to claim 1 wherein a slot is defined in said base member through which said strap passes to attach said magnet to said strap.

3. The dispensing apparatus according to claim 1 wherein said strap comprises a hook and loop type fastener.

4. A method of dispensing objects responsive to magnetic attraction comprising the steps of:

providing a permanent magnet in the form of an annular ring defining a center aperture therethrough and comprising an outer edge and an inner edge and having a saucer-shaped surface such that said ring slopes downwardly from said outer edge to said inner edge said ring having a base member below said saucer-shaped surface to which is attached a strap, wherein said center aperture extends through said saucer-shaped surface and said base member to said strap whereby objects placed on said saucer-shaped surface are able to contact said strap through said center aperture;

strapping said permanent magnet to the wrist of a user;

reaching into a group of magnetically responsive objects to be dispensed whereby said magnet attracts and retains said objects to be dispensed;

removing said objects to be dispensed from said magnet in seriatim order.

5. The method according to claim 4 wherein said objects are nails and further comprising the step of hammering a nail.

* * * * *